US005894259A

United States Patent [19]

Kolberg et al.

[11] Patent Number: 5,894,259

[45] Date of Patent: Apr. 13, 1999

[54] THERMAL TRIP UNIT WITH MAGNETIC SHIELD AND CIRCUIT BREAKER INCORPORATING SAME

[75] Inventors: Kenneth D. Kolberg, Robinson Township, Pa.; Mark A. Juds, New Berlin, Wis.

[73] Assignee: Eaton Corporation, Cleveland, Ohio

[21] Appl. No.: 08/839,530

[22] Filed: Apr. 14, 1997

[51] Int. Cl.[6] ..... H01H 37/52; H01H 37/12; H01H 73/48; H01H 75/12

[52] U.S. Cl. ..... 337/333; 337/360; 337/362; 337/392; 335/23; 335/35; 335/37; 335/145; 335/8; 335/10; 335/41

[58] Field of Search ..... 337/1–3, 12–13, 337/35–38, 54, 333; 335/8–10, 21–25, 35–45, 63, 16, 132, 172–176, 202, 195, 236, 237, 162, 163, 37, 145

[56] References Cited

U.S. PATENT DOCUMENTS

| | | | |
|---|---|---|---|
| 3,636,410 | 1/1972 | Pardini | 317/36 TD |
| 4,503,408 | 3/1985 | Mrenna et al. | 335/35 |
| 4,683,451 | 7/1987 | Grunert et al. | 335/174 |
| 4,697,163 | 9/1987 | Grunert et al. | 335/174 |
| 4,719,438 | 1/1988 | Mrenna et al. | 335/38 |
| 4,922,220 | 5/1990 | Livesey et al. | 337/82 |
| 4,951,015 | 8/1990 | Shea et al. | 335/38 |
| 5,225,800 | 7/1993 | Pannenborg et al. | 335/35 |
| 5,296,827 | 3/1994 | DiMarco et al. | 335/16 |
| 5,608,367 | 3/1997 | Zoller et al. | 335/132 |

*Primary Examiner*—Lynn D. Feild
*Assistant Examiner*—Anatoly Vortman
*Attorney, Agent, or Firm*—Martin J. Moran

[57] ABSTRACT

A solenoid type magnetic trip assembly for a molded case circuit breaker includes an armature biased against an adjustable stop by a tension spring to set the initial gap for the magnetic trip, so that the spring bias remains constant for the full range of the initial gap. The armature includes an elongated magnetically permeable member mounted by a frame to slide longitudinally along a pair of guide rails. The frame defines a trip surface axially aligned with the elongated magnetically permeable member which engages a trip arm on a trip bar to trip the circuit breaker in response to a predetermined level of overcurrent. A bimetal providing a thermal trip function is cantilevered from a support spaced from the trip bar by the armature, but has a terminal portion at the free end projecting toward the trip bar and through which the elongated magnetically permeable member of the armature extends. A radially enlarged slug on the free end of the elongated magnetically permeable member of the armature is subjected to a magnetic force opposite to the force generated by load current tending to pull the armature into the solenoid coil. This opposing force increases as the initial gap increases, placing the slug closer to the magnetic frame, so that a greater range of trip currents can be selected despite limited room for armature travel. A gap in the magnetic frame prevents short circuiting the magnetic field where the few turns of a large gauge coil wire produce an unsymmetrical winding. A magnetic shield protects the bimetal from deformation during high current short circuits.

6 Claims, 8 Drawing Sheets

FIG. 9
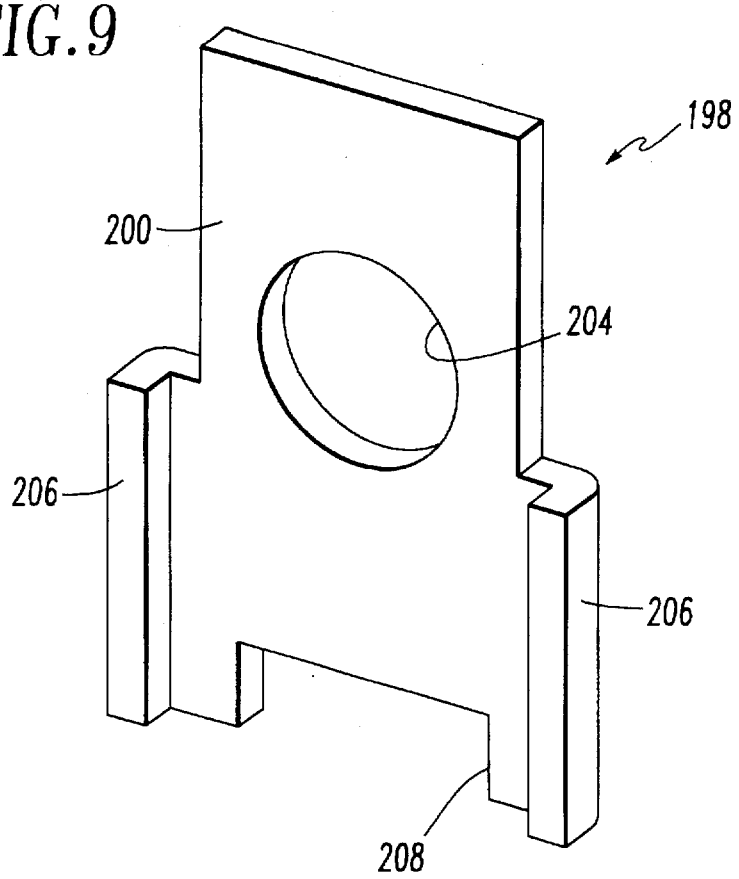
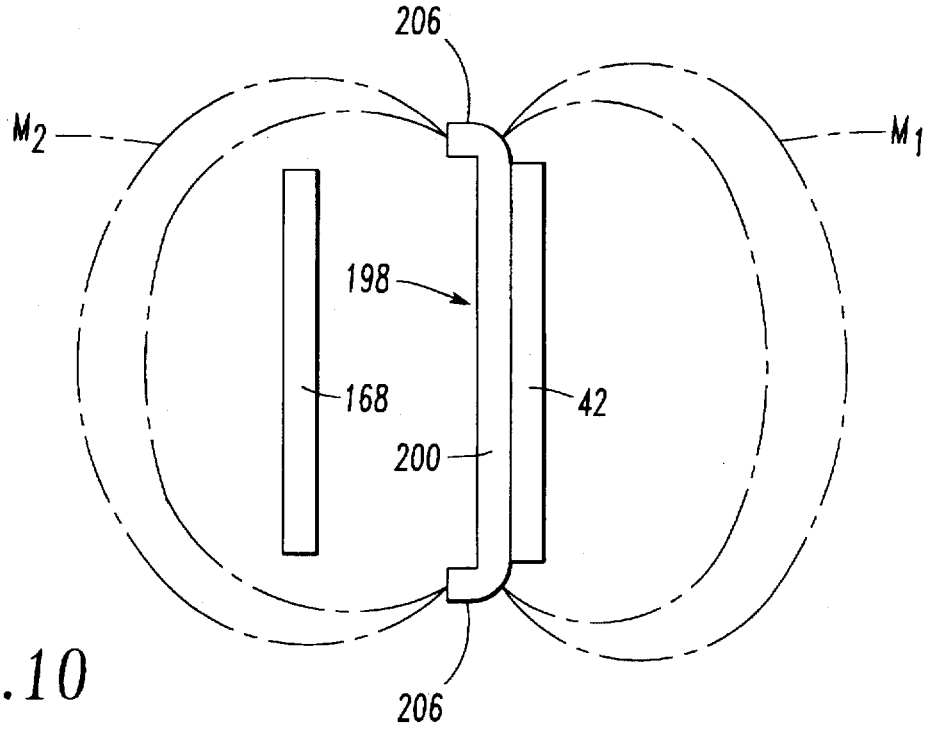
FIG. 10

THERMAL TRIP UNIT WITH MAGNETIC SHIELD AND CIRCUIT BREAKER INCORPORATING SAME

CROSS REFERENCE TO RELATED APPLICATIONS

Commonly owned and concurrently filed U.S. patent application Ser. No. 08/840,158 entitled "ADJUSTABLE TRIP UNIT AND CIRCUIT BREAKER INCORPORATING SAME" and identified by attorney docket no. 96-PDC-290.

Commonly owned and concurrently filed U.S. patent application Ser. No. 08/837,143 entitled "MAGNETIC TRIP ASSEMBLY AND CIRCUIT BREAKER INCORPORATING SAME" and identified by attorney docket no. 96-PDC-293.

BACKGROUND OF THE INVENTION

1. Field of the Invention

This invention relates to thermal-magnetic trip units for circuit breakers and to circuit breakers incorporating such trip units. More particularly, it relates to an arrangement for preventing deformation of a bimetal providing the thermal trip function by the magnetic repulsion forces generated by short circuit currents.

2. Background Information

Circuit breakers typically provide protection against persistent overcurrent conditions and against the very high currents produced by short circuits. This type of protection is provided in many circuit breakers by a thermal-magnetic trip unit. The thermal portion of the trip unit is commonly a bimetal which is heated as a function of the magnitude and duration of the overcurrent. This causes the bimetal to bend and release the latch of a spring powered operating mechanism which opens the circuit breaker contacts to interrupt current flow. The very high current of a short circuit generates a magnetic field which acts upon an armature in the magnetic portion of the trip unit to unlatch the spring loaded operating mechanism.

In a common type of molded case circuit breaker in which the power contacts, operating mechanism and trip unit are mounted inside of a molded insulative housing, the bimetal is fixed to a cantilevered end of the load terminal conductor with the bimetal spaced from, but extending parallel to, the load terminal conductor. In a directly heated bimetal, a flexible shunt is connected adjacent the free end of the bimetal so that the bimetal and the load conductor form a folded electrical path between the flexible shunt and the load terminal in which current flows in one direction in the bimetal and in the opposite direction in the load terminal conductor. This generates magnetic repulsion forces which, in the case of the high currents associated with a short circuit, can be large enough to cause deformation of the bimetal. Some such terminal trip units have a calibration lever also fixed to the cantilevered end of the load conductor and positioned between the load conductor and the bimetal. A calibration screw threaded into an aperture in the load conductor engages the free end of the calibration lever. The calibration screw is turned to draw the free end of the calibration lever closer to or move it further away from the aperture in the load conductor. While the load conductor is made of copper, the calibration lever is typically made of steel so that rotation of the calibration screw results in bending of the cantilevered end of the load conductor. This results in adjustment of the free end of the bimetal relative to a trip bar to adjust the conditions under which the circuit breaker is tripped. As the calibration lever is made of steel, it provides some magnetic shielding for the bimetal, but only adjacent the fixed end of the bimetal.

There is a need for an improved thermal trip unit, and a circuit breaker incorporating the same, in which the large magnetic forces generated by short circuit currents do not result in deformation of the thermal trip bimetal.

There is a need for such an improved trip unit which does not require redesigning the basic structure of the trip unit.

There is an additional need for such an improved trip unit in which the protection against deformation of the bimetal requires minimal space.

There is yet another need for such an improved trip unit which is inexpensive and easy to implement.

SUMMARY OF THE INVENTION

These needs and others are satisfied by the invention which is directed to a thermal trip unit, and a circuit breaker incorporating the thermal trip unit, in which magnetic shield means is provided between the elongated load conductor and the cantilevered bimetal. This magnetic shield means is preferably in the form of a magnetically permeable planar member extending transversely between the elongated load conductor and the bimetal. This magnetically permeable planar member channels the magnetic flux, produced by the current flowing in the opposite directions in the bimetal and the load conductor forming the folded electrical path, in a manner which reduces the repulsion forces. By channelling the magnetic flux produced by current in the load conductor, the repulsion force on the cantilevered bimetal is reduced. At the same time, the planar member provides a path for the flux generated by the current flowing in the bimetal which results in an attractive force on the bimetal. The positioning of the planar member between the elongated load conductor and the bimetal can be selected to reduce the net force acting on the bimetal. In the exemplary embodiment of the invention, the planar member is secured, as by brazing to the elongated load conductor. In order to increase the attractive force acting on the bimetal, the planar member is provided with peripheral flanges extending parallel to the elongated load conductor and bimetal and projecting toward the bimetal. In this embodiment of the invention, the planar member is provided with an opening through which the calibration screw extends between the load conductor and the calibration lever. Also where the flexible shunt connected to the free end of the bimetal faces the load conductor, a cut out is provided in this shield to prevent short circuiting of the thermal trip unit.

BRIEF DESCRIPTION OF THE DRAWINGS

A full understanding of the invention can be gained from the following description of the preferred embodiments when read in conjunction with the accompanying drawings in which:

FIG. 9 is an isometric view of a magnetic shield which protects the bimetal.

FIG. 10 is a cross section through the magnetic shield, the bimetal and the load conductor illustrating the effect of the shield on the magnetic flux.

DESCRIPTION OF THE PREFERRED EMBODIMENT

Figure 1:
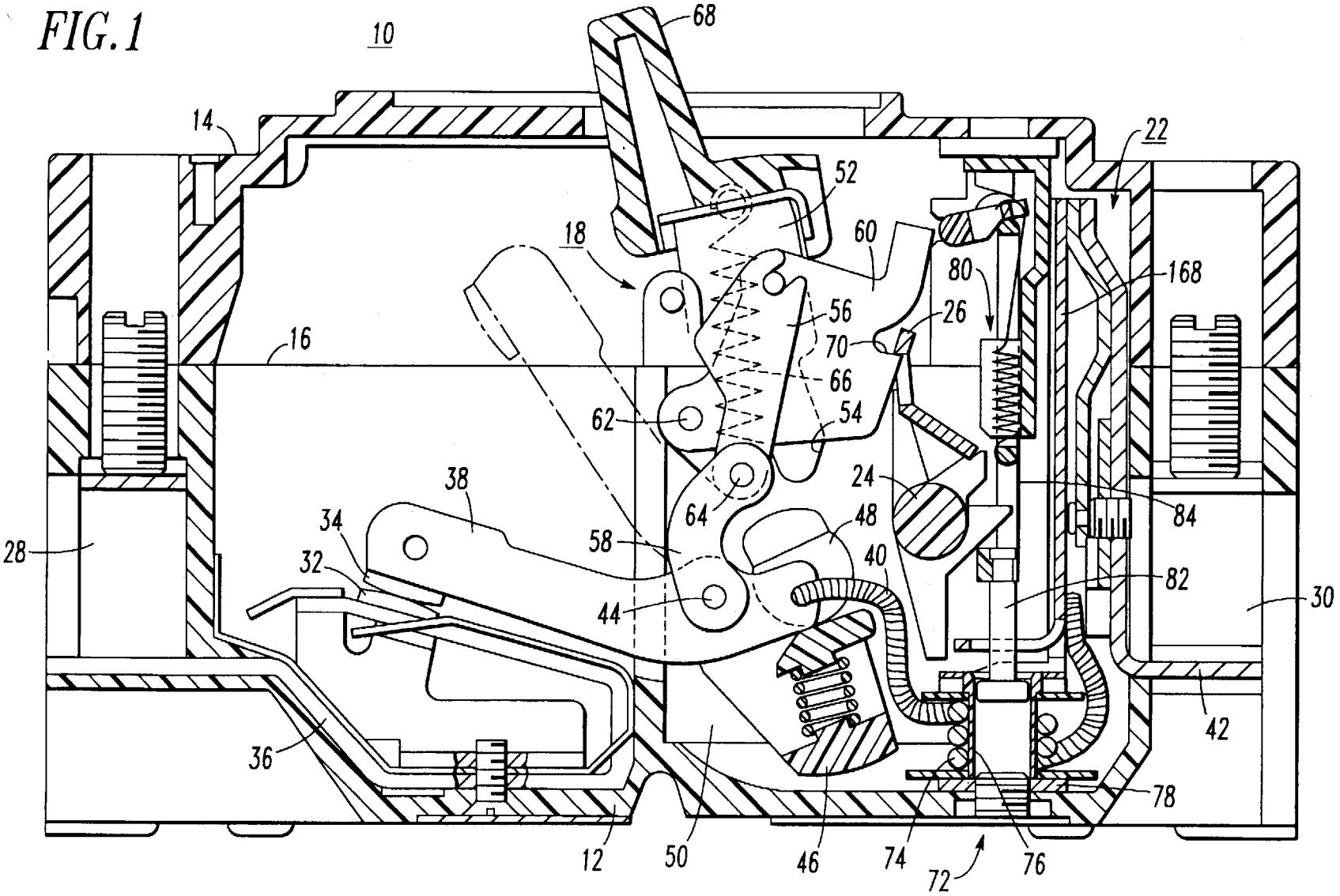
FIG. 1 is a longitudinal cross section through a circuit breaker in accordance with the invention.

In FIG. 1, a molded case circuit breaker generally indicated at 10 comprises an insulating housing or base 12 having a cover 14 which is mechanically attached at a parting line 16 and retained in place by a plurality of fasteners, such as screws (not shown). The circuit breaker may be of a single or multiple pole construction. The latter construction comprises insulating barriers separating the interior of the housing into adjacent side-by-side pole unit compartments in a well known manner. For a multiple pole unit, such as a three-pole circuit breaker, a latchable operating mechanism 18 is disposed in the center pole unit. However, each pole unit includes a separate thermal magnetic trip device 22 for rotating a common trip bar 24 which in turn releases a latch lever 26 on the latchable operating mechanism 18.

For a polyphase circuit breaker, a pair of similar terminals including line terminal 28 and load terminal 30, at opposite ends of the breaker 10, are provided for each phase. The terminals 28, 30 are employed to serially electrically connect the circuit breaker 10 into an electrical circuit such as a three-phase circuit, to protect the electrical system involved.

The circuit breaker 10 is disclosed (FIG. 1) in the closed position with a pair of separable contacts including a fixed contact 32 and a moveable contact 34 in electrical contact with each other. In that position, a circuit through the circuit breaker extends from the line terminal 28 through a conductor 36, the contacts 32, 34, a contact arm 38, a shunt 40, the trip unit 22, and a conductor 42 to the load terminal 30.

The contact arm 38 is pivotally connected at a pin 44 to a rotatable carriage 46, which is secured to or integral with a crossbar 48. The contact arm 38 and the carriage 46 rotate as a unit with the crossbar 48 during normal current conditions through the circuit breaker 10. The spring powered operating mechanism 18 is typical of that set forth in U.S. Pat. No. 4,503,408 for which reason it is not described herein in detail. Suffice it to say, the mechanism 18 is positioned between spaced plates 50 (one of which is shown) which are fixedly secured to base 12 of the center pole unit. An inverted U-shaped operating lever 52 is pivotally supported in U-shaped notches 54 on the plates with the ends of the legs of the lever supported on the notches 54 of the plates.

The operating mechanism 18 includes an over center toggle having an upper toggle link 56 and a lower toggle link 58 which connect the contact arm 38 to a releasable cradle member 60 that is pivotally supported on the plates 50 by a pin 62. The toggle links 58, 56 are pivotally connected by means of a knee pivot pin 64. Over center operating springs 66 are connected under tension between the knee pivot pin 64 and the bight portion of the lever 52. A handle 68 is mounted on the upper end of the lever 52 for manual operation of the operating mechanism 18.

Contacts 32, 34 are normally manually separated by movement of the handle 68 to the right from the ON position shown in FIG. 1 to an OFF position. However, they can also be opened automatically by the trip unit 22 through the trip bar 24 and latch lever 26 which engages a notch 70 in the cradle member 60. For the purpose of this invention, the circuit breaker operation mechanism 18 is shown as being tripped solely by the trip unit 22. Other means for tripping such as separate high speed electromagnetic trip devices are described elsewhere such as in U.S. Pat. No. 4,220,935.

Figure 2:
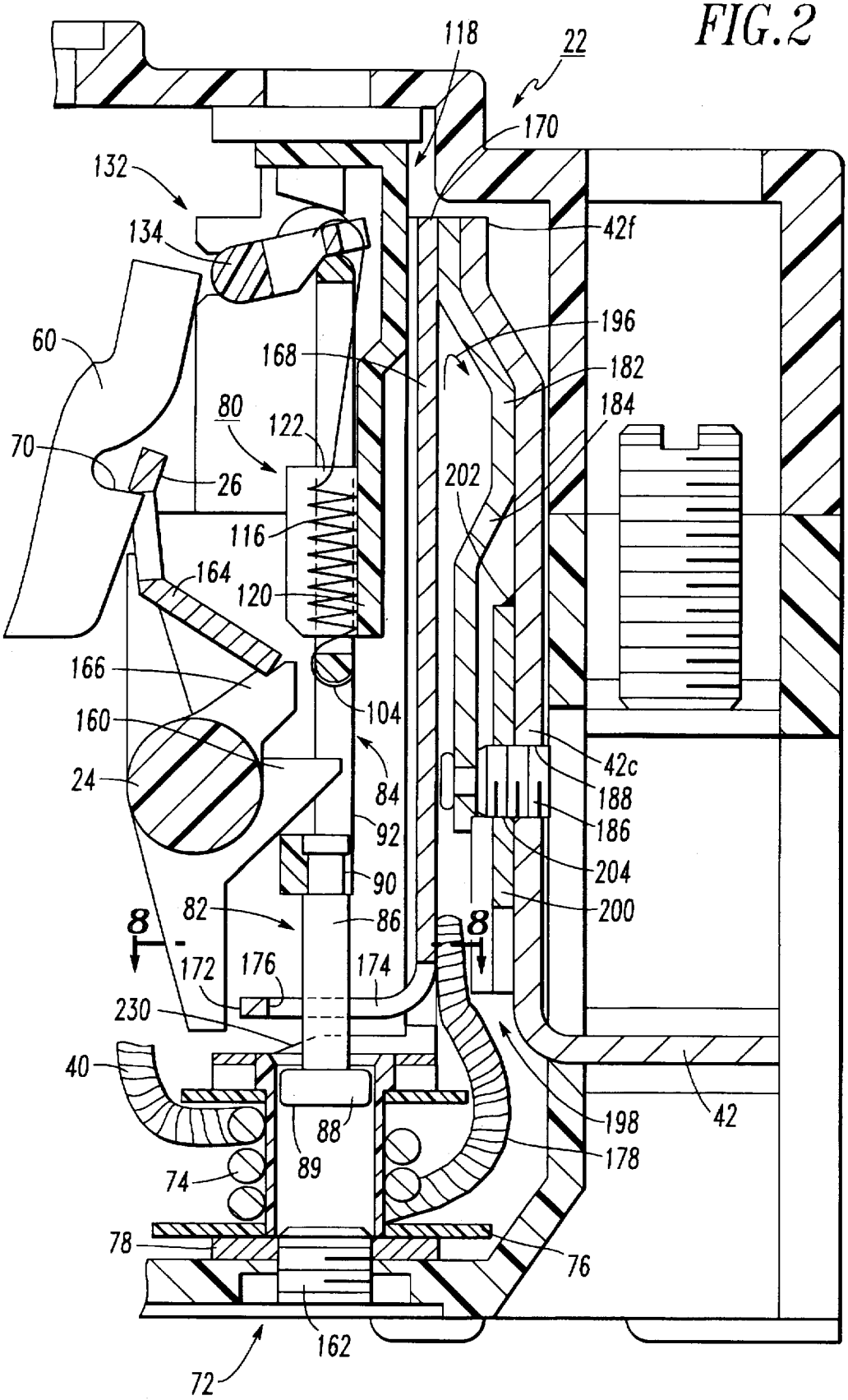
FIG. 2 illustrates in enlarged scale the trip unit which forms a part of the circuit breaker of FIG. 1.
Figure 3:
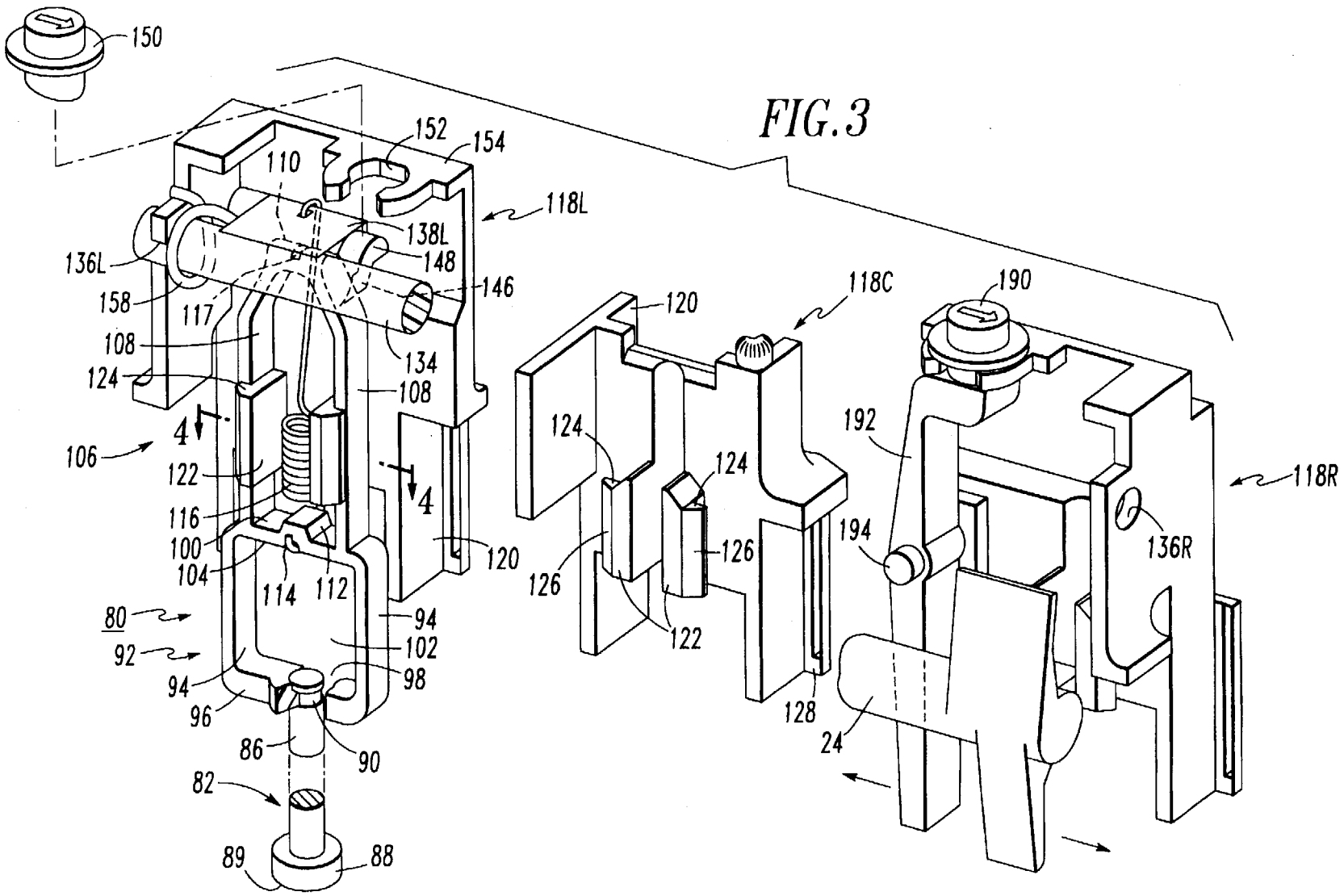
FIG. 3 is an exploded, isometric view of part of the magnetic trip assembly of the trip unit.
Figure 4:
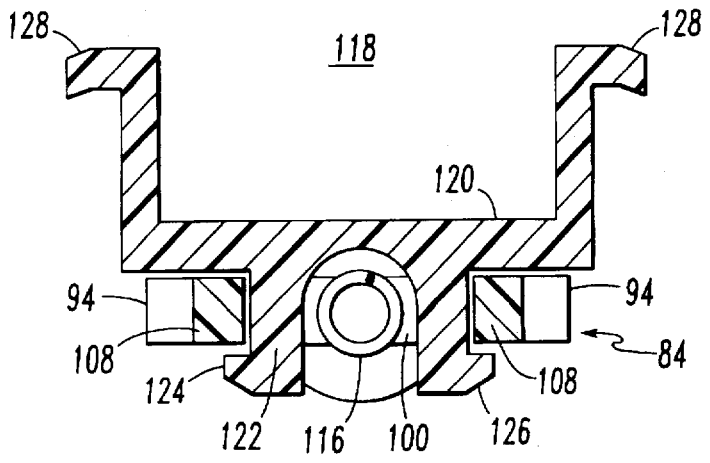
FIG. 4 is a cross section through part of the magnetic trip assembly taken along the line 4—4 in FIG. 3.

The trip unit 22 is an adjustable thermal-magnetic trip device. As best seen in FIGS. 2–4, the magnetic trip function is performed by an electromagnetic assembly 72 which includes a coil 74 wound on a bobbin 76 and mounted inside a magnetic frame 78. The electromagnetic assembly 72 further includes an armature 80. This armature 80 includes an elongated armature element 82 and a frame 84. The elongated armature element 82 includes a cylindrical shaft 86 with an enlarged, cylindrical slug 88 at the lower, proximal end 89 and an annular groove 90 adjacent the upper end.

The frame 84, which is preferably molded from an insulative resin, includes a lower section 92 having side members 94 joined at their lower ends by a bottom member 96. This bottom member 96 is enlarged at the center to accommodate a re-entrant, counterbored aperture 98 into which the grooved upper end of the elongated armature element 82 is snapped. A cross member 100 forms with the side members 94 and the bottom member 96 an opening 102 with the bottom surface of the cross member 100 forming an engagement surface 104.

The upper portion 106 of the armature frame 84 is formed by a pair of spaced apart side members 108 joined at their upper ends by a top member 110.

The cross member 100 of the frame 84 has a raised center section 112 with beveled sides, and a groove 114 in the engagement surface 104 centered under the raised section 112. The lower end of a tension spring 116 is hooked in the groove 114 with the spring extending upward between the side members 108. The upper end of the spring may be retained in a groove 117 in the top member 110, although this is only temporary during assembly.

The armature 80 is supported by a mounting bracket 118. The mounting bracket 118 has a channel-shaped body 120 for rigidity. Extending outward on the web of the body 120 are a pair of spaced apart guide rails 122. At the end of the guide rails 122 are outwardly directed flanges 124 which are chamfered at their outer edges 126. The armature 80 is mounted on the bracket by pressing the side members 108 against the chamfers 126. The side members being molded of a resin material spread outward and then snap in behind the flanges 124 so that the frame 84 can slide along the rails 122. Thus, the elongated armature element or plunger 82 moves axially in and out of the coil 74. As seen in FIG. 3, left, right and center bracket 118L, 118R, and 118C are provided for the three poles of the three pole circuit breaker. The mounting brackets 118 have mounting ribs 128 extending laterally outward from the body 120 for engaging mounting slots 130 in the base of the circuit breaker (see also FIGS. 4 and 17).

Figure 5:
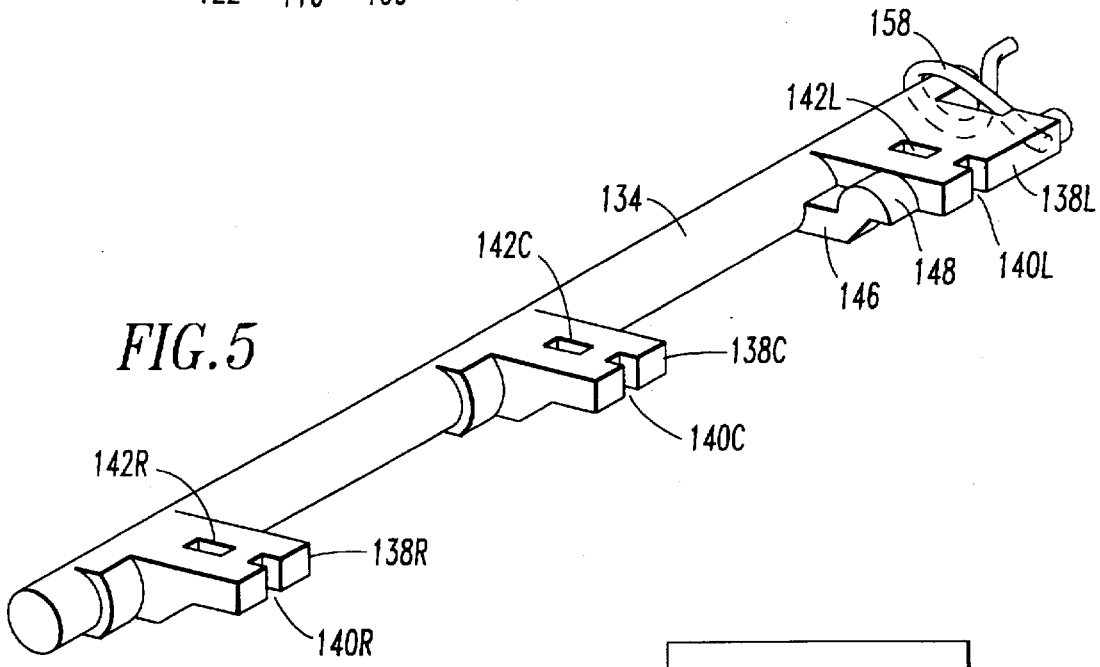
FIG. 5 is an isometric view of the positioning bar which forms part of the magnetic trip assembly.
Figure 6:
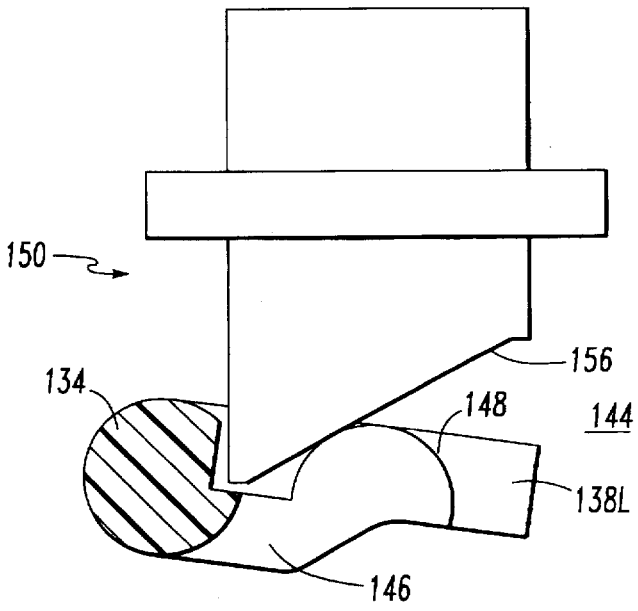
FIG. 6 is a section through the magnetic adjustment for the trip unit.

An adjustment mechanism 132 adjustably sets the initial position of the armature 80 and, therefore, of the plunger 82 relative to the coil 74. As best seen in FIGS. 2, 5 and 6, this adjustment mechanism 132 includes a common positioning bar 134 which extends across all three poles and is journaled at its end at apertures 136L and 136R of the brackets 118L and 118R, respectively (See FIG. 3). Actuating arms 138L, 138R, and 138C project laterally from the positioning bar and are centered over the armature frames 84 for each of the poles. Each of these arms 138 has a notch 140 at the end and an aperture 142 spaced from the notch 140. The upper ends of the springs 116 engage the notch 140 and aperture 142 in the associated arm 138 to bias the respective armature frame 84 against the associated arm 138. Thus, the arms 138 form upper stop members for the respective armatures 80. The initial positions of all of the armatures 80 are set by a common adjustment device 144 which includes a cantilevered adjustment arm 146 projecting laterally from the positioning bar 134. This adjustment arm has a cylindrical upper surface 148.

The common adjustment device 144 of the adjustment mechanism 132 further includes an adjustment member or nob 150 rotatably mounted in an re-entrant aperture 152 in a flange 154 on the bracket 118L, as best seen in FIG. 3. The head of the adjusting member 150 has a slot for receipt of a tool such as a screw driver for rotating the adjustment member. On the bottom of the adjustment member is an eccentric cam surface 156. A torsion spring 158 biases the positioning bar 134 so that the cylindrical surface 148 on the adjusting arm 146 bears against this eccentric cam surface 156. Thus, by turning the adjustment member 150, the positioning bar 134 is rotated. As the armatures are biased against the arms 138 on the positioning bar 134 by the springs 116, each of the armatures 80 are positioned simultaneously relative to the associated coil 74.

Returning to FIG. 2, the trip bar 24 includes trip arms 160 for each pole which project into the openings 102 in the frames 84. With the armature biased up against the positioning bar by the spring 116, there is a space between the engagement surface 104 on the armatures and the associated trip arm 24. When the current through the coil 74 exceeds the magnetic trip current, the magnetic force generated by this current draws the plunger 82 downward into the coil toward a calibration plug 162 threaded into the bottom of the magnetic frame 78. As the armature 80 is drawn downward, the engagement surface 104 contacts the trip arm 160 and rotates the trip bar clockwise, as shown in FIG. 2. As the trip bar rotates, a secondary latch plate 164 is released by the latch arm 166 on the trip bar. This in turn allows the latch lever 26 to unlatch the operating mechanism which then rapidly opens the main contacts in a manner well known.

Figure 7:
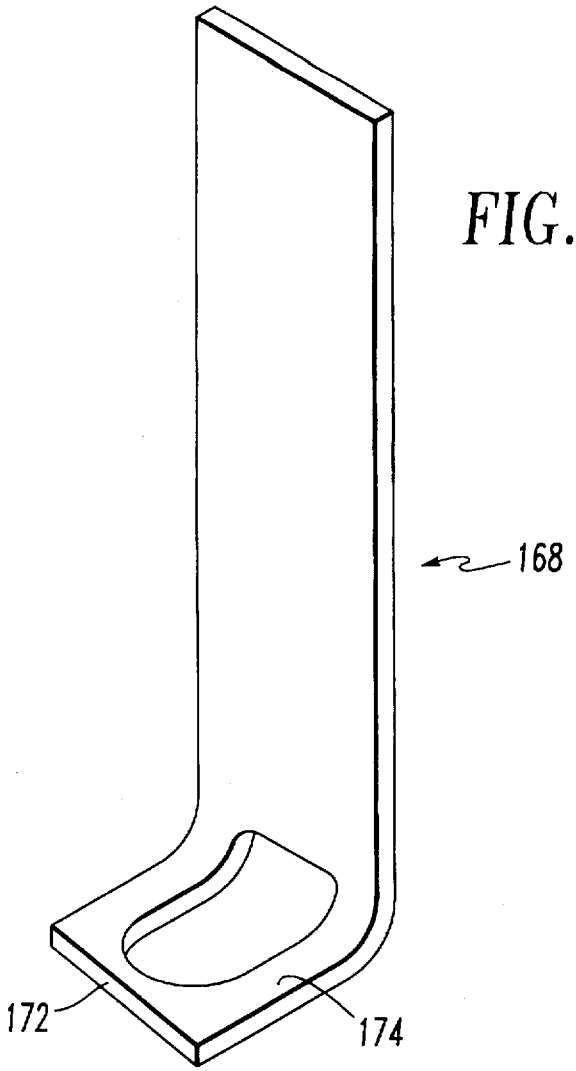
FIG. 7 is an isometric view of a bimetal which provides the thermal trip function for the circuit breaker.
Figure 8:
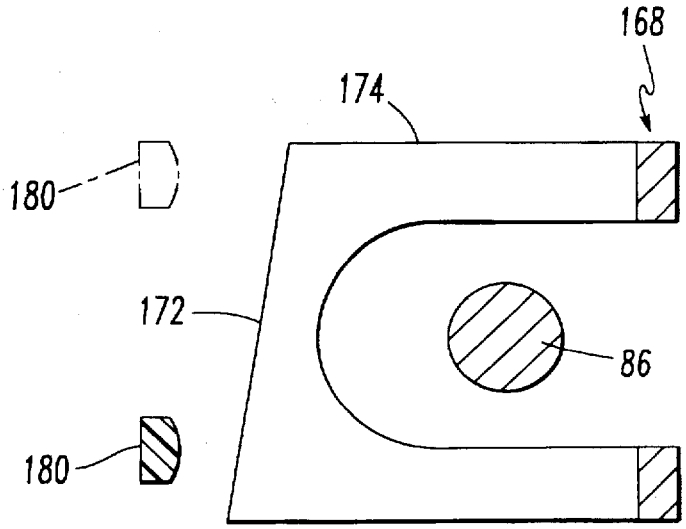
FIG. 8 is a cross section through the bimetal and a portion of the trip bar taken along the line 8—8 in FIG. 2.

The thermal trip function of the trip unit 22 is performed by a bimetal 168 which is secured at a first upper end 170 to the upper, free end **42*f* of the load conductor 42. As best seen in FIGS. 2, 7 and 8, the bimetal 168 extends downward generally parallel to the armature 80 which is positioned between the bimetal and the trip bar 24. The bimetal 168 has a free, second end 172 on a terminal portion 174 which projects the free end 172 toward the trip bar 24. The elongated armature element 82 of the armature extends through an opening 176 in this terminal portion 174. In the embodiment of the invention shown, a second flexible shunt 178 connects the lower end of the bimetal 168 to the coil 74. In this arrangement, the bimetal 168 is directly heated by load current which passes from the coil 74 through the bimetal to the load conductor 42. As is known in the art, the bimetal can also be indirectly heated by passing the current through a conductor placed adjacent to the bimetal. The bimetal 168, whether heated directly or indirectly, bends in response to load current. Persistent overcurrents cause the free end 172 of the bimetal to contact a thermal trip arm 180** to rotate the trip bar and trip the circuit breaker open.

Calibration of the bimetal 168 is provided as is known by a calibration lever 182 which is also brazed to the upper, free end **42*f* of the load conductor 42. The calibration lever extends parallel to the load conductor 42, but is spaced from it by an offset 184. A calibration screw 186 is threaded into a tapped aperture 188 swaged into the load conductor 42 and engages the free end of the calibration lever 182. The center section 42*c* of the load conductor 42 adjacent the aperture 188 is supported within the base 12 of the circuit breaker housing. Adjustment of the calibration screw 186 causes the free end of the load conductor 42 to bend thereby adjusting the spacing between the free end 172 of the bimetal and the thermal trip arm 180 on the trip bar 24. The calibration screws 186 provide for a relative adjustment of the individual bimetals. Adjustment of the thermal trip function is effected by a common adjustment screw 190 which engages a common thermal adjustment lever 192 pivoted about an axis 194 transverse to the trip bar 24 as shown in FIG. 3. The thermal adjustment lever 192 slides the trip bar 24 axially. As seen in FIG. 8, the free end 172 of the bimetal is cut on a bias so that rotation of the thermal adjust screw results in adjustment of the effective gap between the bimetal 168 and the thermal trip arm 180** on the trip bar.

As can be appreciated from FIG. 2, the bimetal 168 and load conductor 42 form a current path 196 which is folded on itself. Current flows in opposite directions in the two legs of this folded current path 196 resulting in the generation of magnetic repulsion forces. As the load conductor 42 is firmly secured in the base 12 of the circuit breaker housing, these repulsion forces tend to push the free end 172 of the bimetal 168 away from the load conductor toward the trip arm 180. The very high currents associated with the short circuit produce repulsion forces of a magnitude which can cause permanent deformation of the bimetal due to the proximity of the bimetal to the load conductor 42. In order to prevent such deformation, a magnetic shield 198 is placed between the bimetal 168 and the load conductor 42 as shown in FIG. 2.

Referring to FIG. 9, the magnetic shield 198 is formed by a planar member 200 made of a magnetic material such as, for instance, mild steel. The planar member 200 extends transversely between the load conductor 42 and the bimetal 168 and longitudinally from just above the calibration screw 186 where it is secured to the load conductor by a braze 202, to the vicinity of the free end 172 of the bimetal. An aperture 204 accommodates the calibration screw 168. The magnetically permeable planar member 200 captures a large proportion of the magnetic field $M_1$ generated by the load conductor 42, as shown in FIG. 10, and channels it away from the bimetal 168. It also provides a low reluctance path for the field $M_2$ generated by the current flowing through the bimetal resulting in the application of an attractive force to the bimetal. By adjusting the position of the planar member 200 in the gap between the bimetal and the load conductor, the attractive force generated by the magnetic shield 198 can be balanced against the repulsion force which, though reduced by the magnetic shield, still acts on the bimetal, so that the net force approaches zero, or at least is reduced below levels which would deform the bimetal. As the planar member 200 of the magnetic shield is secured to the load conductor and, therefore, closer to the load conductor, the attractive force applied to the bimetal is increased by providing peripheral flanges 206 extending along the side edges of the planar member 200 generally parallel to and projecting toward the bimetal 168. The exact distance that these flanges 206 project toward the bimetal can be empirically determined to reduce the net force on the bimetal to a level below that which will cause permanent deformation of the bimetal. In the exemplary circuit breaker, the magnetic shield is made of mild steel 0.062 inches (1.57 mm) thick, having a length of 1 inch (25.4 mm) and a width of 0.72 inches (18.3 mm), with the flanges 206 extending 0.062 inches (1.57) mm toward the bimetal. Also in the particular embodiment of the invention where the shunt 178 is brazed to the bimetal 168 facing the load conductor, a cut out 208 is provided in the planar member 200 to avoid short circuiting the bimetal.

It should be noted that the calibration lever 182 is also made of mild steel and, therefore, provides some additional magnetic shielding for the bimetal 168. However, with this calibration lever being close to the fixed end of the bimetal, it provides insufficient shielding for the sizeable repulsion forces acting upon the free end 172 of the bimetal through the long moment arm created by the cantilevered bimetal.

As mentioned above, the electromagnetic assembly 72 includes a magnetic frame 78. This magnetic frame 78 which is best shown in FIGS. 11–14 has a first end 210, and a spaced apart second end 212 joined by first and second sides 214 and 216, to form a rectangular magnetic path. The coil 74 is wound on the bobbin 76 which supports the coil within the magnetic frame 78 with its axis extending between the first and second ends 210 and 212 of the magnetic frame 78. An opening 217 in the first end 210 permits the elongated armature element 82 of the armature 80 to extend into the helical coil.

Due to the limited space within the base 12 for the electromagnetic assembly 72, the sides 214 and 216 of the magnetic frame 78 are shorter than the length of the ends 210 and 212. This constraint in addition to the limited room for axial movement of the armature 80, makes it difficult to provide a wide range of adjustment for the magnetic trip function. The present invention overcomes this limitation in part by providing the slug 88 on the distal end of the elongated armature element 82. As is conventional in this type of magnetic trip mechanism, current flowing through the coil 74 generates a magnetic field which draws the elongated armature element (82) into the coil through the opening 217 in the end 210 of the magnetic frame 78 to trip the circuit breaker, as described above. A conventional magnetic calibration screw 162 threaded into a tapped hole 218 in the second or bottom end 212 of the magnetic frame 78 and accessible through an opening in the base 12, makes fine adjustments in the initial main gap 220 between the slug 88 and the calibration screw to calibrate the individual pole. As discussed above, further adjustment of the main gap 220 is made by the adjustment mechanism 132 to set the main gap 220 for tripping the circuit breaker at a desired current level.

Figure 12:
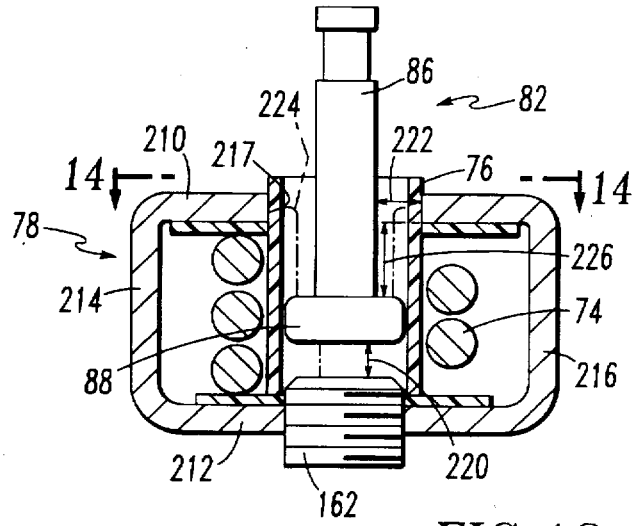
FIG. 12 is a cross section through the electromagnetic assembly showing the initial gap setting for minimum trip current.
Figure 13:
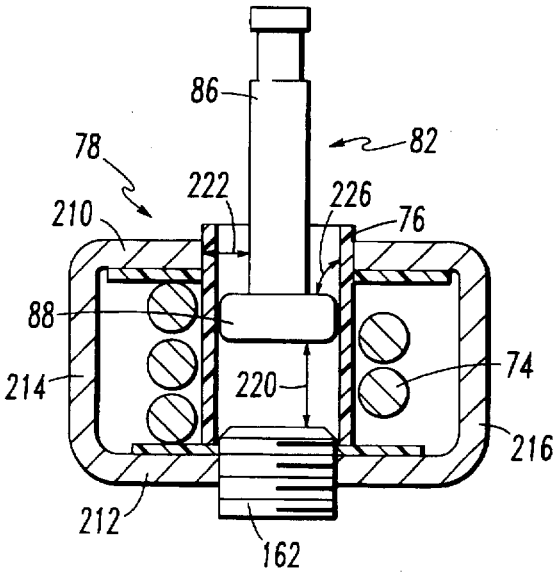
FIG. 13 is a cross section similar to FIG. 12 showing a magnetic gap set for maximum trip current.

As can be seen from FIGS. 12 and 13, the slug 88 has a larger transverse dimension or diameter than the shaft 86. When current is initially applied to the coil 74, the magnetic flux circulates through the magnetic frame and the calibration screw 162, the main gap 220, the slug 88, the shaft 86 and the radial gap 222 between the shaft and the upper end 210 of the magnetic frame at the opening 217. The magnetic force generated by this flux tends to pull the slug 88 down to the calibration screw 218. With the diameter of the slug 88 being larger than that of the shaft 86, some of the magnetic flux 224 passes from the first end 210 of the frame directly to the top surface of the slug 88 through a secondary gap 226 extending generally axially along side of the shaft 86. This generates a force acting upward on the slug 88 tending to pull it away from the calibration screw 18 in opposition to the force in the main gap 220 pulling the slug downward. When the main initial gap 220 is set to the minimum, as shown in FIG. 12, the secondary gap 226 is at a maximum thereby providing the lowest setting for the trip current. As the initial main gap 220 is increased so that more current is required to trip the circuit breaker, as shown in FIG. 13, the initial secondary gap 226 is decreased which increases the upward force applied to the slug 88. Thus, this reduction in the secondary gap 226 further increases the current required to trip the circuit breaker. It can be seen, therefore, that the armature with the enlarged slug at the free end increases the range of trip currents for a given change in the length of the initial main gap 220.

Figure 11:
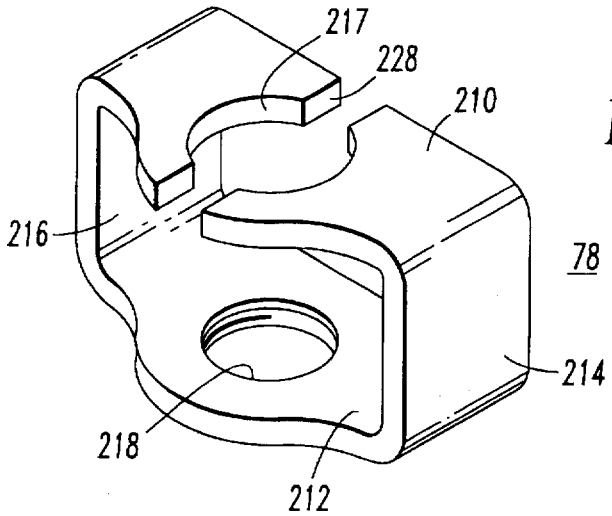
FIG. 11 is an isometric view of a magnetic frame which forms part of the magnetic trip assembly.
Figure 14:
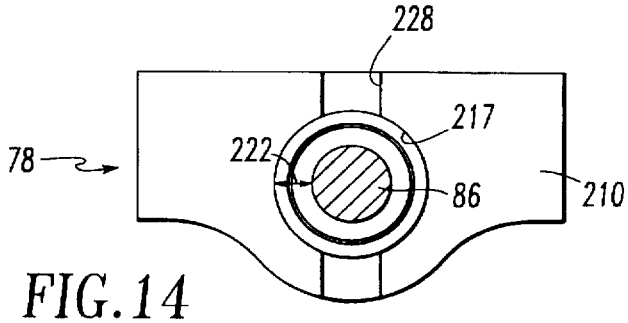
FIG. 14 is a top view of the magnetic assembly taken along the line 14—14 in FIG. 12.

It will be noticed that with the large diameter of the conductor which forms the coil 74, there are three turns on the left side of the coil, as viewed in FIGS. 12 and 13, and two turns on the right side. This creates an imbalance in the magnetic flux generated by the coil 74 which is short circuited by the magnetic frame 78. The result is that the additional flux generated by the extra turn on one side of the coil tends to circulate in the magnetic frame and not pass across the gap 222 into the shaft 86. In order to reduce this tendency, a transverse gap 228 is provided in the first end 210 of the magnetic frame 78 at the opening 217, as can be seen in FIGS. 11 and 14 for instance.

Figure 15:
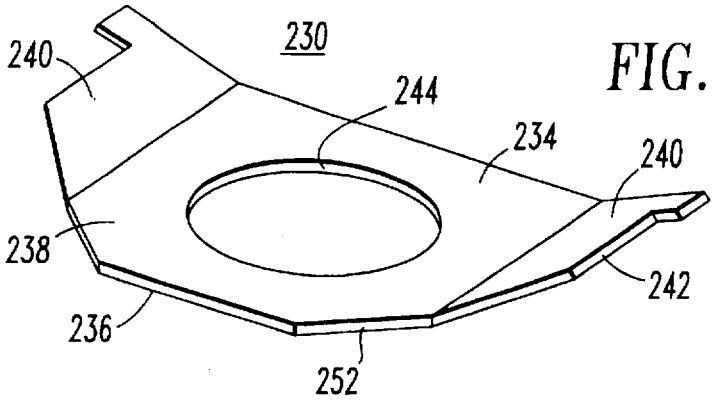
FIG. 15 is an isometric view of a spring clip which secures the magnetic assembly in the circuit breaker housing.
Figure 16:
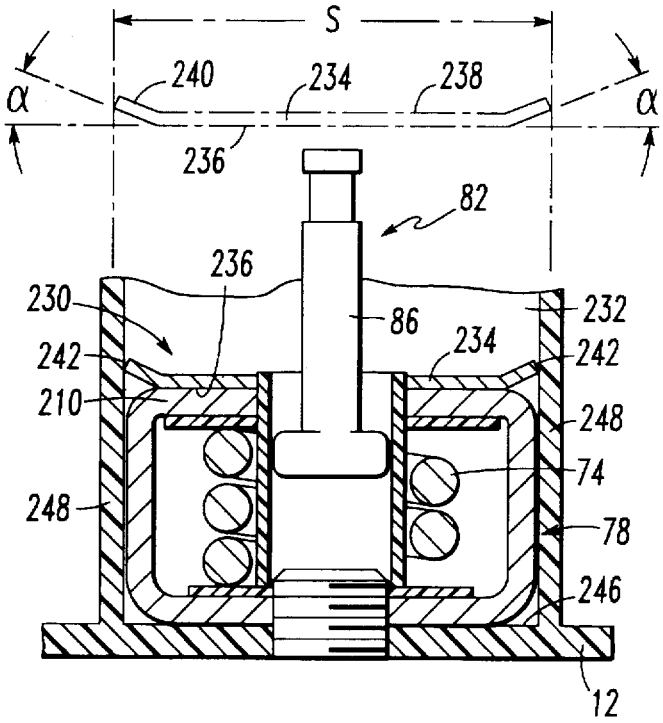
FIG. 16 is a partial transverse cross section through the circuit breaker illustrating retention of the magnetic assembly by the spring clip.

In order to assure accurate operation of the trip unit, the various components must be securely fixed within the circuit breaker, especially in view of the sizeable magnetic forces which are generated. This includes the magnetic frame 78 which must be firmly anchored to assure the stability of the operation of the magnetic trip. Again, space limitations place constraints on the types of connections which can be used. The present invention utilizes a mounting clip 230 to secure the magnetic frame 78 within a recess 232 as shown in FIG. 16. The mounting clip 230, which is shown isometrically in FIG. 15, is made from a sheet of non-magnetic spring material such as a phosphorous bronze alloy. The mounting clip 230 has a flat center section 234 having a first face 236 and a second face 238, and a pair of end sections 240 each bent at an acute angle $\alpha$ to the plane of the center section 234 (see FIG. 16). These end sections or wings 240 terminate in free edges 242. The flat central section 234 of the mounting clip has an opening 244 through which the elongated armature element 82 of the armature 80 extends.

Figure 17:
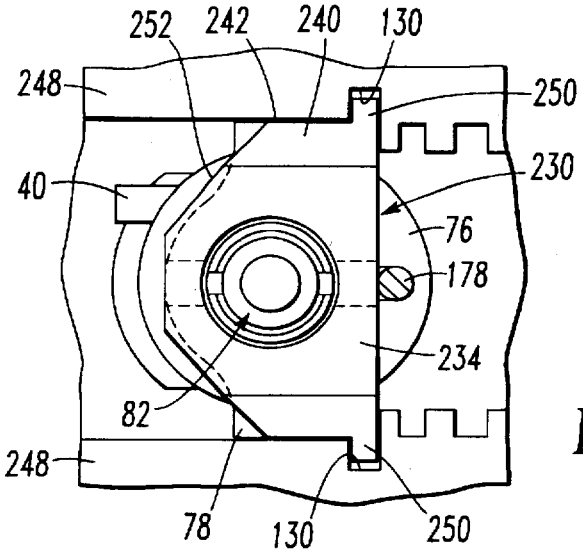
FIG. 17 is a horizontal cross section through the circuit breaker housing illustrating retention of the magnetic assembly by the spring clip.

As best seen from FIGS. 16 and 17, the magnetic frame rests on the bottom wall 246 of the recess 232 between the side walls 248. With the magnetic frame 78 seated in the recess 232, the mounting clip 230 is inserted into the recess with the first face 236 facing the upper end wall 210 of the frame. The length of the end sections or wings 240, and the angle $\alpha$ which they make with the flat section 234, makes the spacing S between the free edges 242 wider than the recess 232 so that there is an interference fit between the mounting clip and the recess 232. Thus, as the mounting clip is pressed into the recess 232, the wings 240 trail backward and are bent at a greater angle so that with the flat section 234 pressing firmly against the magnetic frame, the free edges 242 dig into the sidewalls 248 to securely retain the frame in place. In the embodiment shown, the sidewalls have grooves 130 which mount the brackets 118. In this arrangement, the end sections or wings 240 have tabs 250 extending outward therefrom which similarly engage the grooves 130.

The angles α between the wings 240 and the flat, center section 234 of the mounting clip are preferably between about 15° and 30°. In the exemplary circuit breaker, the angles α are 25°. Also in the exemplary embodiment, the forward corners of the flat section 234 and wings 240 are trimmed at 252 to accommodate the shape of the magnetic frame 78 and recess 232.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A thermal trip unit for a circuit breaker comprising:

an elongated load conductor having a supported section a cantilevered section terminating in a free end;

an elongated bimetal having a first end secured to said free end of said elongated load conductor and extending along side, but laterally spaced from said elongated load conductor and terminating in a second, free end;

a flexible conductor secured to said bimetal adjacent said second, free end, said bimetal and said elongated load conductor forming a folded current path between said flexible conductor and said supported section of said elongated load conductor which produces magnetic repulsion forces between said elongated load conductor and bimetal;

a trip device adjacent said second, free end of said bimetal which is actuated by displacement of said second, free end of said bimetal in response to a persistent overcurrent through said folded current path;

magnetic shield means comprising a magnetically permeable planar member disposed transversely between said elongated load conductor and said bimetal, and having peripheral flanges extending generally parallel to and projecting toward said bimetal; and wherein said flexible conductor is secured to said bimetal facing said magnetic shield means and wherein said planar member has a cutout to accommodate said flexible conductor.

2. A thermal trip unit for a circuit breaker comprising:

an elongated load conductor having a supported section a cantilevered section terminating in a free end;

an elongated bimetal having a first end secured to said free end of said elongated load conductor and extending along side, but laterally spaced from said elongated load conductor and terminating in a second, free end;

a flexible conductor secured to said bimetal adjacent said second, free end, said bimetal and said elongated load conductor forming a folded current path between said flexible conductor and said supported section of said elongated load conductor which produces magnetic repulsion forces between said elongated load conductor and bimetal;

a trip device adjacent said second, free end of said bimetal which is actuated by displacement of said second, free end of said bimetal in response to a persistent overcurrent through said folded current path;

magnetic shield means comprising a magnetically permeable planar member disposed transversely between said elongated load conductor and said bimetal, and having peripheral flanges extending generally parallel to and projecting toward said bimetal;

wherein said planar member is secured to said elongated electrical conductor;

wherein said elongated load conductor is copper and said magnetically permeable planar member is steel; and wherein said peripheral flanges project toward said bimetal a distance which generates an attractive force between said shield means and said bimetal which substantially offsets said repulsion forces.

3. A thermal trip unit for a circuit breaker comprising:

an elongated load conductor having a supported section and a cantilevered section extending from said supported section and terminating in a free end;

an elongated bimetal having a first end secured to said free end of said elongated load conductor and extending along side, but laterally spaced from, said elongated load conductor and terminating in a second, free end;

a flexible conductor secured to said bimetal adjacent said second, free end, said bimetal and said elongated load conductor forming a folded current path between the flexible conductor and the supported section of said elongated load conductor which produces a magnetic repulsion force between said elongated load conductor and said bimetal;

a trip device adjacent said second, free end of said bimetal which is actuated by displacement of said second, free end of said bimetal in response to a persistent overcurrent through said folded current path;

calibration means comprising a calibration lever secured at a fixed end to said free end of said elongated load conductor, and a calibration screw extending between a free end of the calibration lever and said supported section of said elongated load conductor and adjustable to draw said free end of said calibration lever toward and away from said supported section of said elongated load conductor to bend said cantilevered section of said elongated load conductor, including said free end, to adjust said initial gap between said second, free end of said bimetal and said trip device;

magnetic shield means comprising a magnetically permeable member disposed between said supported section of said elongated load conductor and said second, free end of said bimetal;

wherein said magnetically permeable member comprises a magnetically permeable planar member extending transversely between said supported section of said elongated load conductor and said bimetal adjacent said second, free end of said bimetal; and wherein said magnetically permeable planar member extends alongside said elongated load conductor from a point adjacent said second, free end of said bimetal to a point beyond said calibration screw, said magnetically permeable planar member having an aperture through which said calibration screw extends.

4. The thermal trip unit of claim 3 wherein said planar member has peripheral flanges extended generally alongside of said elongated load conductor and projecting toward said bimetal.

5. The thermal trip unit of claim 4 wherein said flexible conductor is secured to said bimetal facing said magnetic shield means and said magnetically permeable planar member has a cutout to accommodate said flexible conductor.

6. A circuit breaker comprising:

a housing;

separable contacts mounted within said housing;

an operating mechanism for opening and closing said separable contacts and for tripping said contacts opened when unlatched by a trip unit; and a thermal trip unit comprising:

an elongated load conductor having a supported section and a cantilevered section extending from said supported section and terminating in a free end;

an elongated bimetal having a first end secured to said free end of said elongated load conductor and extending along side, but laterally spaced from, said elongated load conductor and terminating in a second, free end;

a flexible conductor secured to said bimetal adjacent said second, free end, said bimetal and said elongated load conductor forming a folded current path between the flexible conductor and said supported section of said elongated load conductor which produces a magnetic repulsion force between said elongated load conductor and said bimetal;

a trip device adjacent said second, free end of said bimetal which is actuated by displacement of said second, free end of said bimetal in response to a persistent overcurrent through said folded current path to unlatch said operating mechanism and open said separable contacts;

magnetic shield means comprising a magnetically permeable planar member extending transversely between said supported section of said elongated load conductor and said bimetal adjacent said second, free end of said bimetal; and wherein said planar member has peripheral flanges extending generally alongside said elongated load conductor and projecting toward said bimetal.

* * * * *